US009332889B2

(12) United States Patent
Fadler et al.

(10) Patent No.: US 9,332,889 B2
(45) Date of Patent: May 10, 2016

(54) OFFSET INLET DISHWASHER PUMPS

(71) Applicant: Nidec Motor Corporation, St. Louis, MO (US)

(72) Inventors: Richard J. Fadler, St. Charles, MO (US); Philip S. Johnson, Granite City, IL (US)

(73) Assignee: Nidec Motor Corporation, St. Louis, MO (US)

( * ) Notice: Subject to any disclaimer, the term of this patent is extended or adjusted under 35 U.S.C. 154(b) by 0 days.

(21) Appl. No.: 14/725,860

(22) Filed: May 29, 2015

(65) Prior Publication Data

US 2015/0257626 A1 Sep. 17, 2015

Related U.S. Application Data

(62) Division of application No. 12/750,038, filed on Mar. 30, 2010, now abandoned.

(51) Int. Cl.
*A47L 15/42* (2006.01)

(52) U.S. Cl.
CPC ..... *A47L 15/4225* (2013.01); *Y10T 29/4973* (2015.01); *Y10T 29/49826* (2015.01)

(58) Field of Classification Search
CPC ..... A47L 15/4225
See application file for complete search history.

(56) References Cited

U.S. PATENT DOCUMENTS

2006/0219272 A1* 10/2006 Lee ..... A47L 15/4225 134/56 D

FOREIGN PATENT DOCUMENTS

DE 4302497 A1 * 8/1994

* cited by examiner

*Primary Examiner* — Michael Barr
*Assistant Examiner* — Jason Riggleman
(74) *Attorney, Agent, or Firm* — Hovey Williams LLP

(57) ABSTRACT

A dishwasher pump assembly according to one example embodiment includes a pump having a housing and a pumping chamber within the housing. The pumping chamber includes a fluid inlet and a fluid outlet. The fluid inlet has a center axis. The assembly also includes a motor having a shaft operably coupled to the pump for rotating the pump. The shaft has a center axis that is offset from the center axis of the fluid inlet. Other embodiments, assemblies and methods are also disclosed.

17 Claims, 9 Drawing Sheets

OFFSET INLET DISHWASHER PUMPS

CROSS-REFERENCE TO RELATED APPLICATION

The present application is a divisional application of U.S. patent application Ser. No. 12/750,038, filed Mar. 30, 2010, the entire disclosure of which is hereby incorporated by reference herein.

FIELD

The present disclosure relates to offset inlet dishwasher pumps and related assemblies and methods.

BACKGROUND

This section provides background information related to the present disclosure which is not necessarily prior art.

Dishwashers commonly include a tub for holding dishware and a sump located in the bottom of the tub. A pump is connected to the sump and is driven by a motor. Some dishwashers are designed so that the sump, the pump and the motor can be removed as an assembly from an interior side of the tub, without moving the dishwasher from its installed position (e.g. under a countertop or cabinet). As tub size increases, the space beneath the tub typically shrinks. This can make it difficult or impossible to remove the sump, pump and motor as an assembly from the interior side of the tub without moving the dishwasher from its installed position.

SUMMARY

This section provides a general summary of the disclosure, and is not a comprehensive disclosure of its full scope or all of its features.

According to one aspect of the present disclosure, a method of installing a sump/pump assembly in a dishwasher is disclosed. The dishwasher includes a tub having a bottom with an opening therethrough. The assembly includes a sump, a pump, and a motor coupled to the sump. The pump includes a fluid inlet. The motor includes a shaft operably coupled to the pump for driving the pump. The method comprises positioning the assembly within an interior portion of the tub, inserting at least the motor and the pump of the assembly through the bottom opening of the tub, and coupling the assembly to the dishwasher with the motor and the pump positioned below the tub bottom and with a center axis of the fluid inlet positioned vertically closer to a bottom surface of the tub bottom than is a center axis of the motor shaft.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
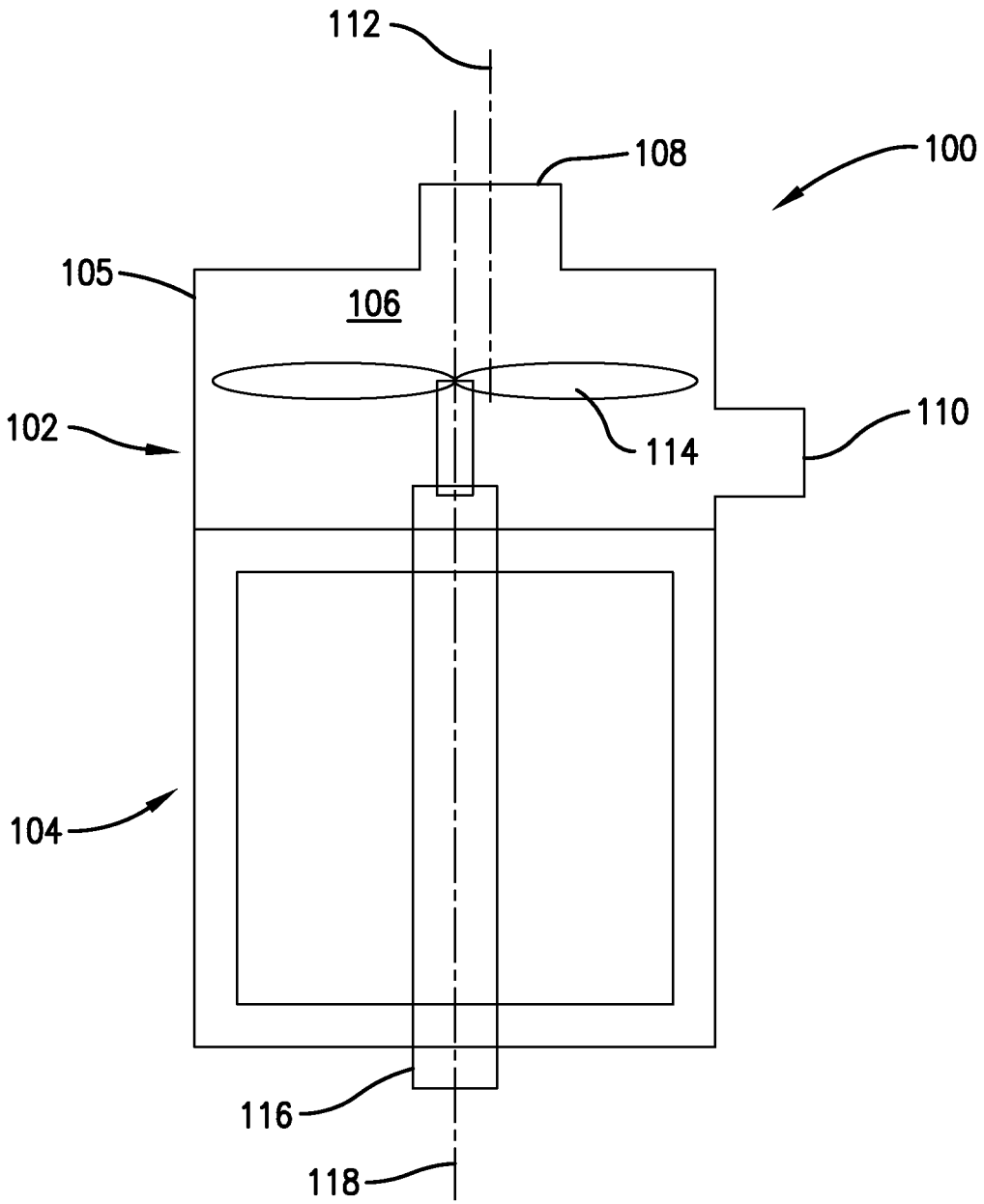
FIG. 1 is a block diagram of a dishwasher pump assembly according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

A dishwasher pump assembly according to one example embodiment of the present disclosure is illustrated in FIG. 1 and indicated generally by reference number 100. As shown in FIG. 1, the assembly 100 includes a pump 102 and a motor 104. The pump 102 includes a housing 105 and a pumping chamber 106 within the housing 105. The pumping chamber 106 has a fluid inlet 108 and a fluid outlet 110. The fluid inlet 108 has a center axis 112. The motor 104 includes a shaft 116 operably coupled to the pump 102 for rotating the pump. The motor shaft has a center axis 118. As shown in FIG. 1, the center axis 118 of the motor shaft 116 is offset from the center axis 112 of the fluid inlet 108. Among other advantages, this offset provides a sufficient amount of space between the motor 104 and a sump (not shown) to facilitate installation or removal of the assembly 100 in a dishwasher.

In the example embodiment shown in FIG. 1, the center axis 118 of the motor shaft 116 extends through the fluid inlet 108. In other embodiments, the shaft center axis 118 may not extend through the fluid inlet 108, e.g., if the offset between the axes 112, 118 is greater than one-half the width or radius of the fluid inlet 108. Additionally, the center axis 118 of the motor shaft 116 is substantially parallel to the center axis 112 of the fluid inlet 108, as shown in FIG. 1. Alternatively, the axes 112, 118 may be non-parallel.

The pump 102 includes an impeller 114 within the housing 105 for moving fluid between the fluid inlet 108 and the fluid outlet 110. In the example of FIG. 1, the center axis of the impeller is coextensive with (i.e., not offset from) the center axis 118 of the motor shaft 116. Accordingly, the impeller's center axis (which is also represented by reference number 118 in the example of FIG. 1) is offset from the center axis 112 of the fluid inlet 108. In other embodiments, the impeller's center axis may be offset from the center axes 112, 118 of the fluid inlet 108 and the motor shaft 116, or coextensive with the center axis 112 of the fluid inlet 108 but offset from the center axis 118 of the motor shaft 116.

Additionally, in the embodiment of FIG. 1, the impeller's center axis is substantially parallel to the center axis 112 of the fluid inlet 108. Alternatively, these two axes can be non-parallel without departing from the teachings of this disclosure.

Further, in the example embodiment of FIG. 1, the impeller's center axis extends through the fluid inlet 108. In other embodiments, the impeller's center axis may not extend through the fluid inlet 108, e.g., if the offset between the impeller's center axis and the center axis 112 of the fluid inlet 108 is greater than one-half the width or radius of the fluid inlet 108.

The motor shaft 116 is operably coupled to the impeller 114 for rotating the impeller 114. The motor shaft 116 may be coupled to the impeller 114 directly, or via one or more gears, belts or other components, for driving rotation of the impeller 114.

The pump 102 is configured to operate as a dishwasher pump. For example, pump 102 may contain a food chopper to break down food removed by the dishwasher. The food chopper may be coupled to the motor shaft 116. Pump 102 may also include seals configured to tolerate, for example, dishwasher cleaning solutions, cleaning agents, hot water, sanitizers, etc. Additionally, impeller 114 is configured to operate as a dishwasher pump impeller. For example, impeller 114 may be designed with sufficient clearance (e.g., about 5 mm) between its blades to allow food to pass therethrough.

Figure 2:
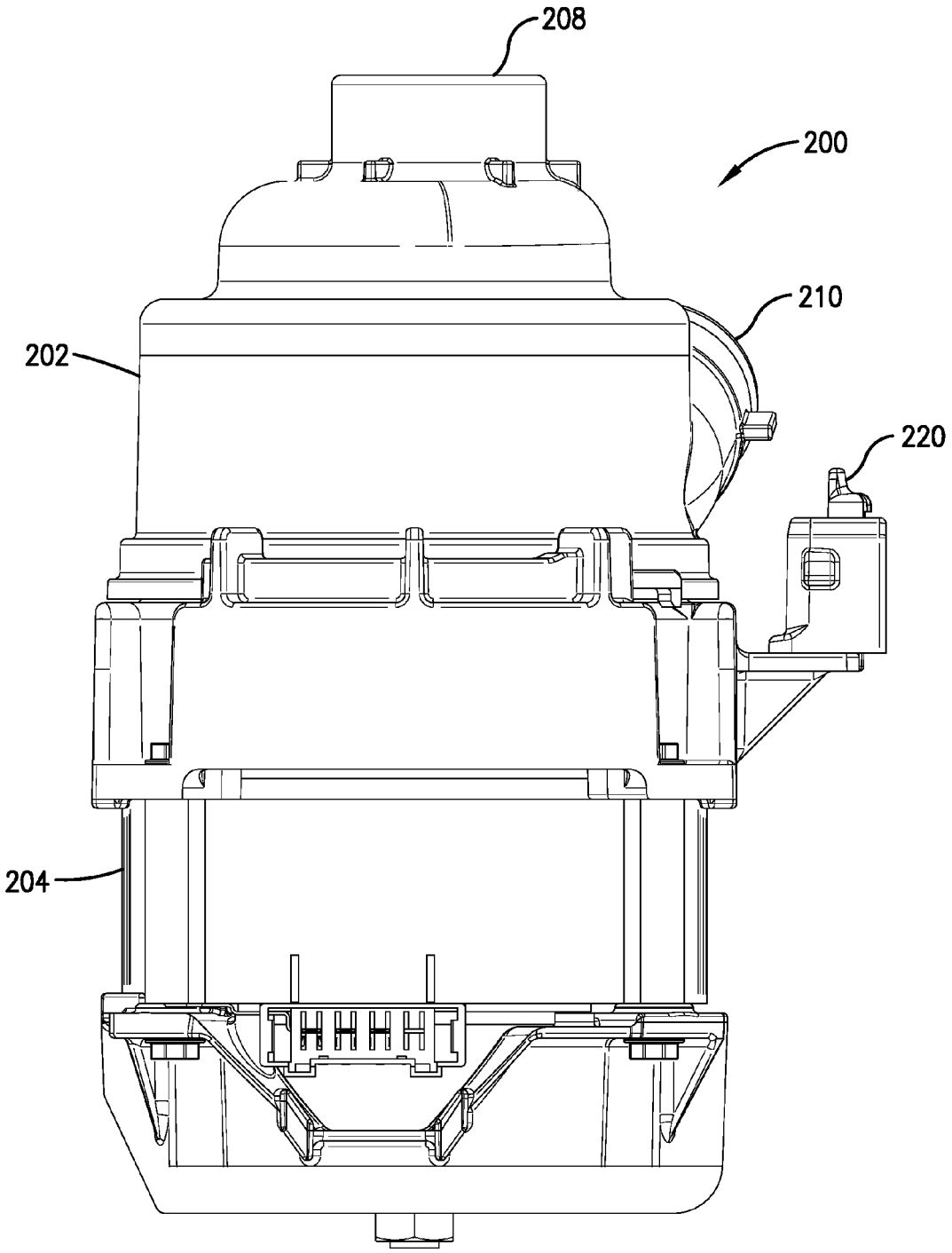
FIG. 2 is a side view of a dishwasher pump assembly according to another example embodiment.
Figure 3:
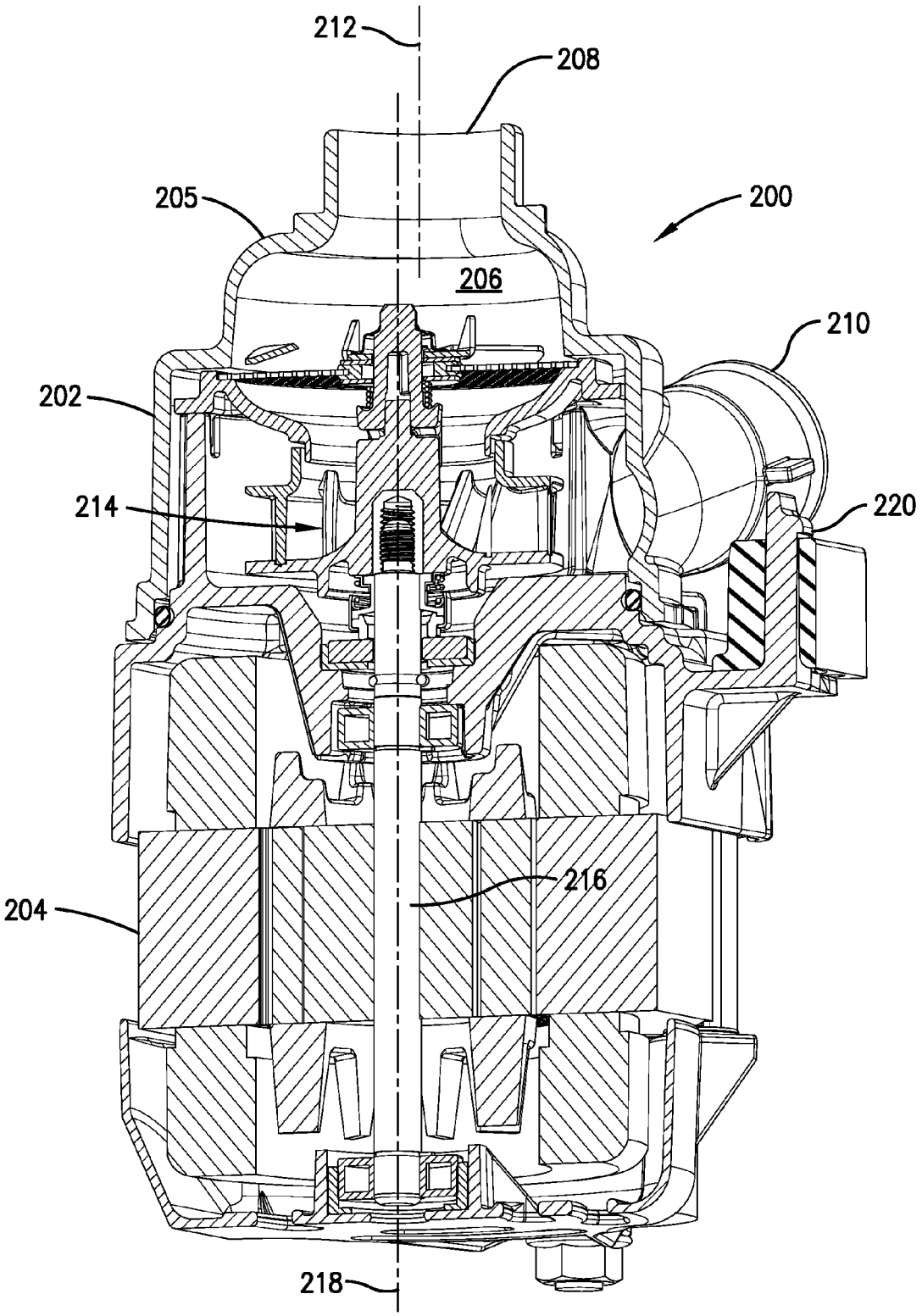
FIG. 3 is a cross-sectional view of the dishwasher pump assembly shown in FIG. 2.

FIGS. 2 and 3 illustrate one example construction of the dishwasher pump assembly 100 described above with reference to FIG. 1. As shown in FIG. 2, the assembly 200 includes a pump 202 and a motor 204. As best shown in FIG. 3, the pump 202 includes a housing 205 having a pumping chamber 206 that has a fluid inlet 208 and a fluid outlet 210. The fluid inlet 208 has a center axis 212. The pump 202 also includes an impeller 214. The motor 204 includes a shaft 216 having a center axis 218.

The impeller 214 is located within the pumping chamber 206 and is driven by the motor shaft 216. Further, the center axis of the impeller 214 is coextensive with the shaft center axis 218. The fluid inlet center axis 212 is offset from the shaft center axis 218, and the shaft center axis 218 extends through the fluid inlet 208.

The dishwasher pump assembly 200 of FIG. 2 also includes a bracket 220 for attaching the assembly 200 to a sump. As further explained below, the bracket 220 can be dimensioned to provide a sufficient gap between the motor 204 and a sump (after the motor is coupled to the sump) to facilitate installation and/or removal of the pump 202, the motor 204, and the sump as a single assembly in a dishwasher without requiring the dishwasher to be moved from its installed location.

In the particular example shown in FIGS. 2 and 3, the bracket 220 is molded into the housing of the motor 204. Alternatively, the bracket 220 may be formed with the pump 202 or with the sump, or formed separately and coupled to the pump 202, the motor 204, or the sump for coupling the motor 204 and/or the pump 202 to the sump.

As best shown in FIG. 3, the center axis 212 of the fluid inlet 208 is positioned closer to the bracket 220 than is the center axis 218 of the motor shaft 216. In other words, the distance between the fluid inlet center axis 212 and the bracket 220 is less than the distance between the shaft center axis 218 and the bracket 220. Alternatively, the shaft center axis 218 maybe positioned closer to the bracket 220 than the fluid inlet center axis 212, e.g., to reduce or eliminate the gap between the motor 204 and a sump (after the motor is coupled to the sump).

Further, the fluid outlet 210 is positioned closer to the bracket 220 than is the fluid inlet 208, the impeller 214, and the motor shaft 216. In other embodiments, the fluid outlet 210 may be positioned farther from the bracket 220 than is the fluid inlet 208, the impeller 214 and/or the motor shaft 216.

Figure 4:
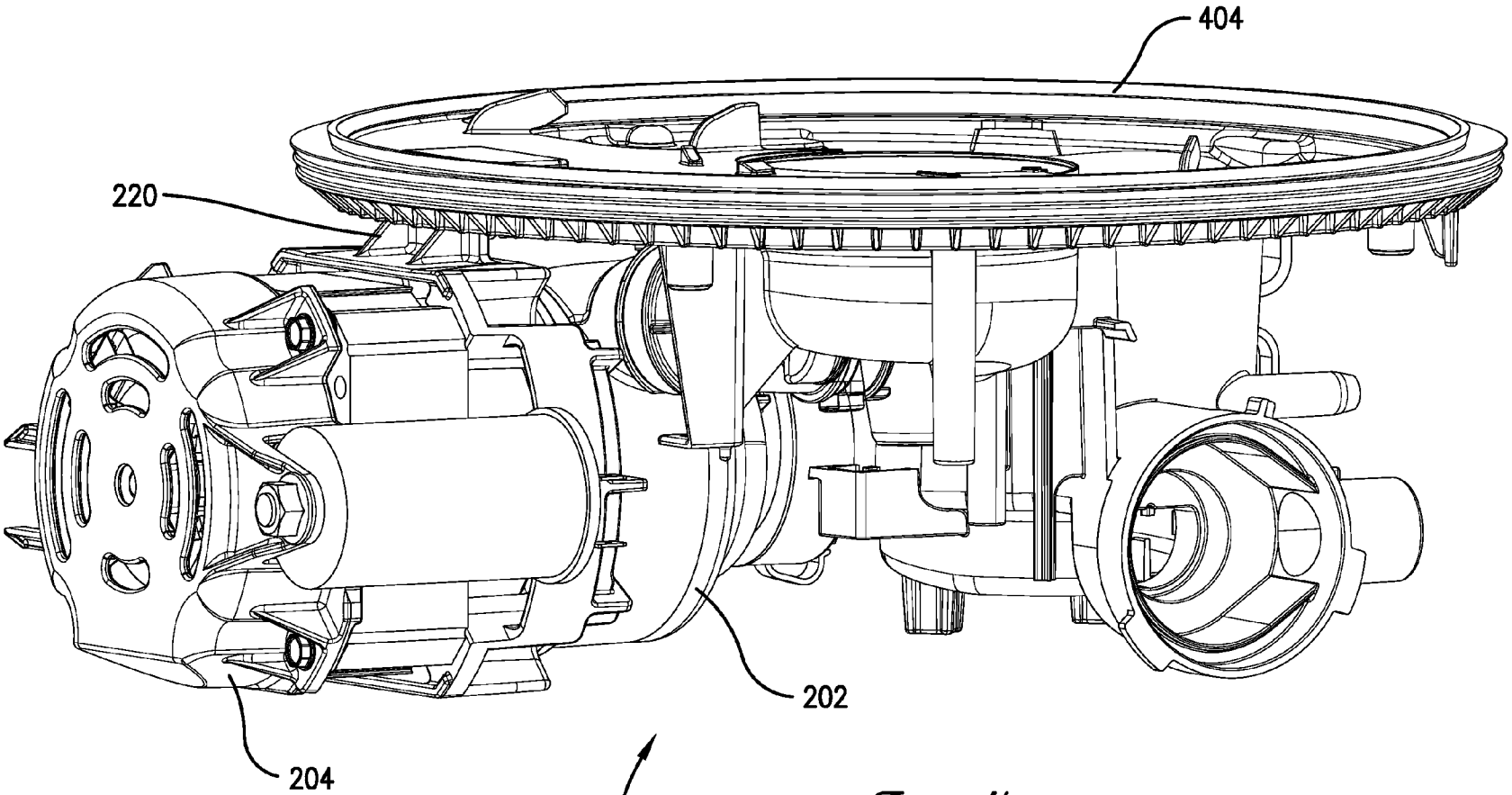
FIG. 4 is a side perspective view of a dishwasher sump/pump assembly according to another example embodiment.
Figure 5:
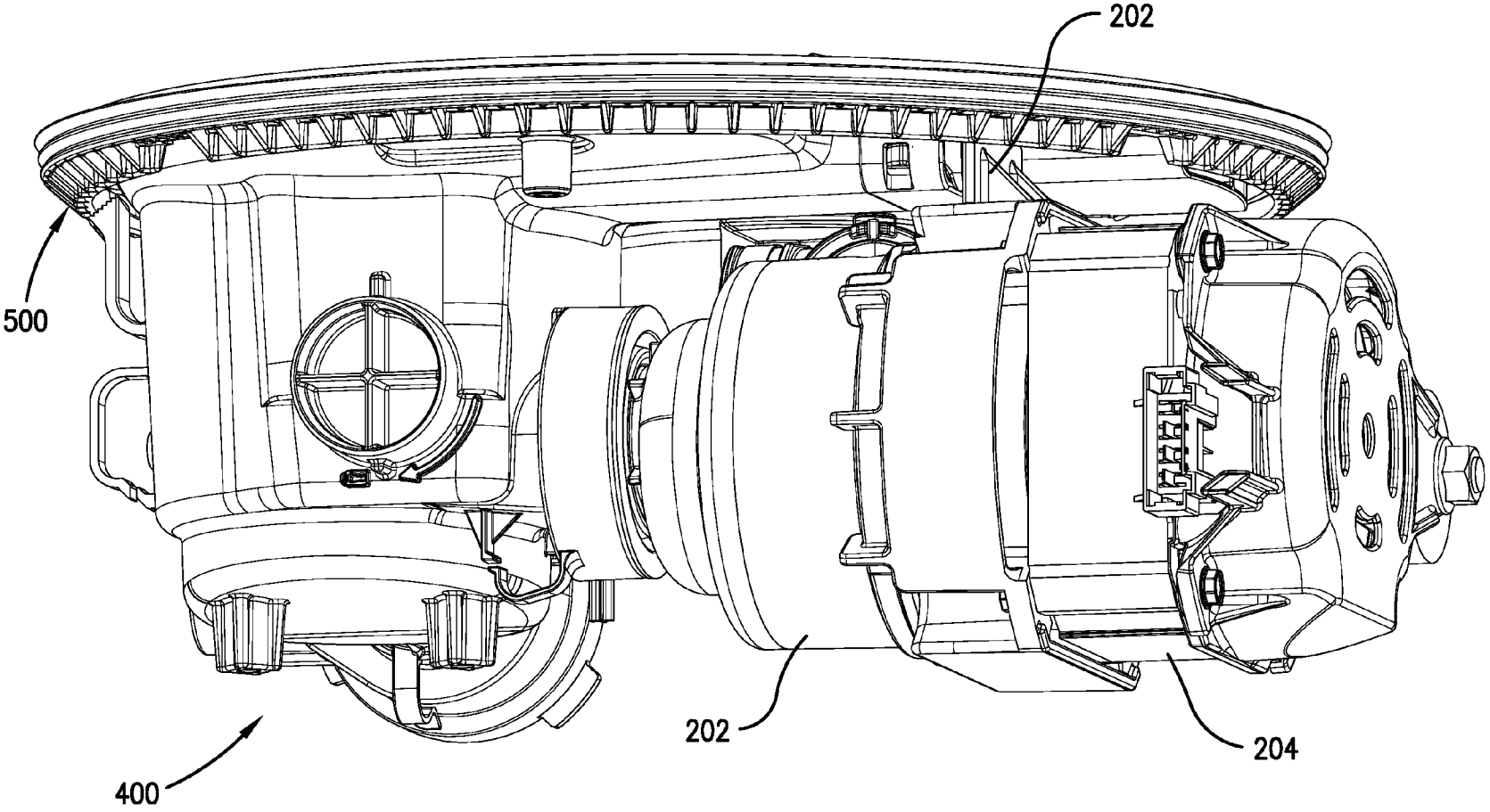
FIG. 5 is another side perspective view of the dishwasher sump/pump assembly shown in FIG. 4.
Figure 6:
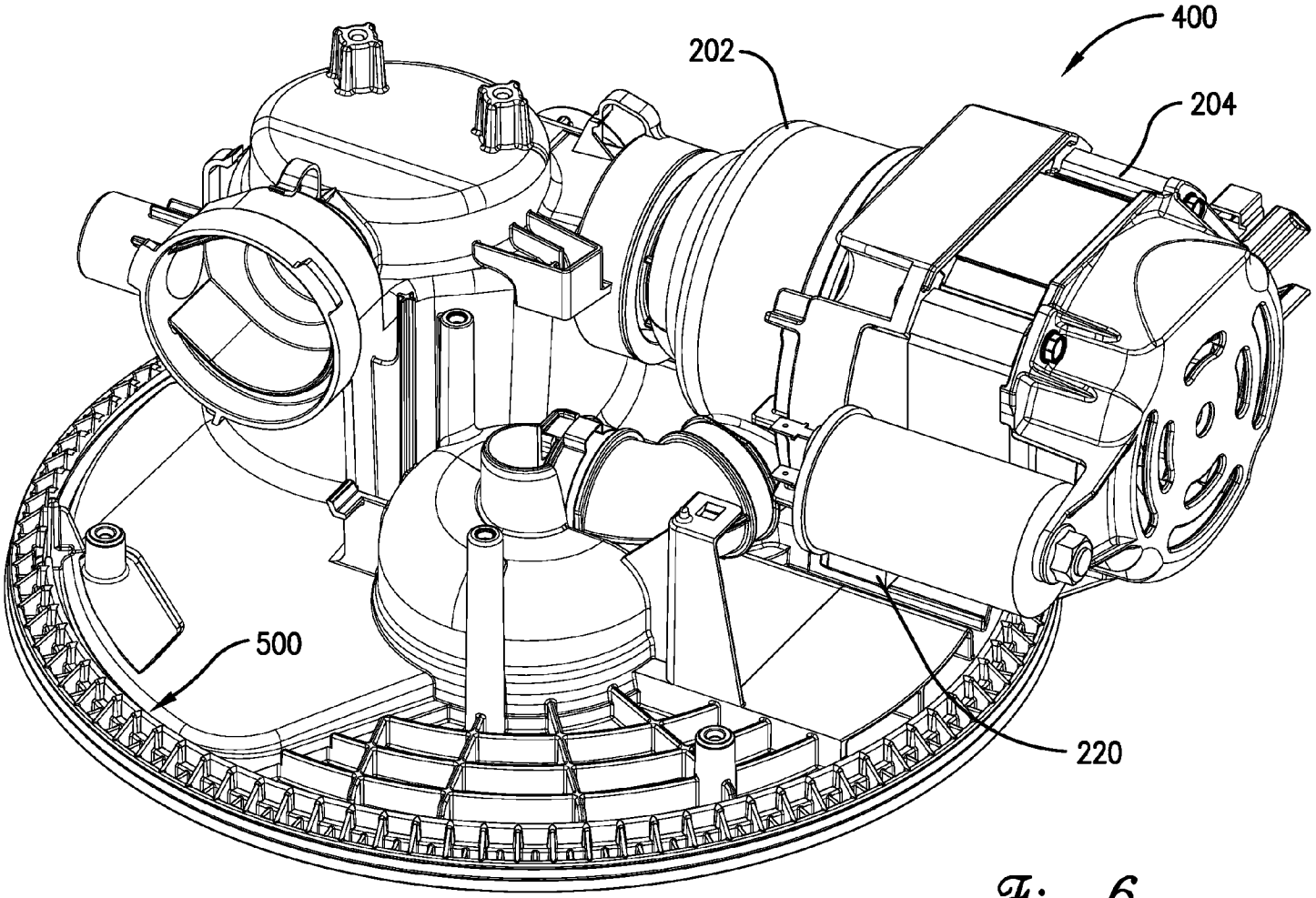
FIG. 6 is a bottom perspective view of the dishwasher sump/pump assembly shown in FIG. 4.

FIGS. 4-6 illustrate an assembly 400 according to another example embodiment. As shown therein, the assembly 400 includes the pump 202 and the motor 204 of FIG. 2, and a sump 404. In this particular example, the pump 202 is directly coupled to the motor 204 and plumbed to the sump 404. Additionally, the motor 204 is rigidly mounted to the sump 404 and hangs from the sump via the bracket 220. Further, the mounting between the motor 204 and the sump 404 is tuned to reduce noise. Alternatively, the motor 204 (and/or the pump 202) may be flexibly mounted to the sump 404. Further, it should be understood that other suitable pumps, motors and sumps may be employed in the assembly 400 without departing from the scope of this disclosure.

The sump 404 may include a support surface 500 for coupling the sump 404 to a dishwasher tub. The support surface 500 may be coupled to the dishwasher tub directly, via a gasket, or otherwise. Alternatively, other approaches may be employed for coupling the sump to the dishwasher tub.

As noted above with reference to FIG. 3, the center axis 212 of the fluid inlet 208 is positioned closer to the bracket 220 than is the center axis 218 of the motor shaft 216. Likewise, in the example assembly 400 shown in FIGS. 4-6, the shaft center axis 218 is spaced further from the support surface 500 than is the center axis 212 of the fluid inlet 208. Alternatively, the shaft center axis 218 may be positioned closer to the support surface 500 than the fluid inlet's center axis 212.

Figure 7:
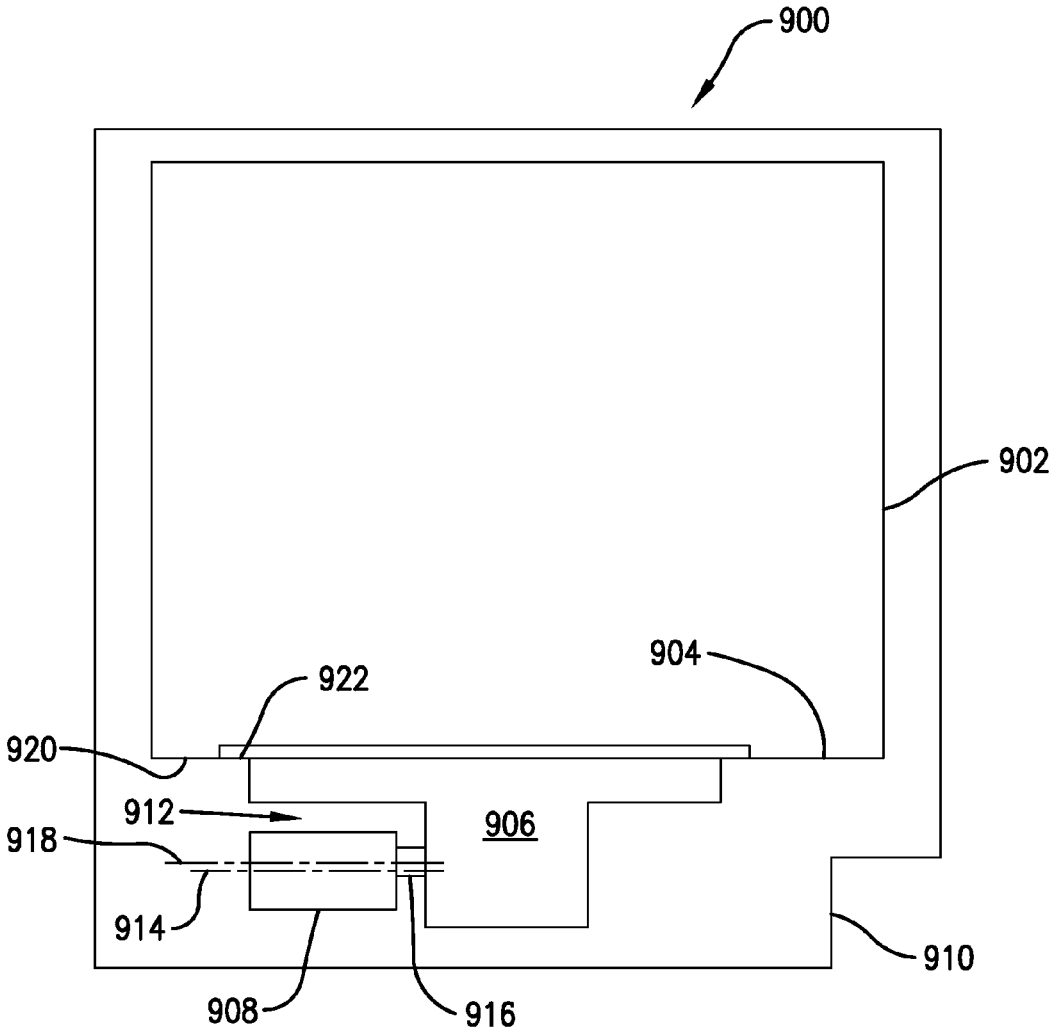
FIG. 7 is a block diagram of a dishwasher according to yet another example embodiment.

FIG. 7 illustrates a dishwasher 900 according to another example embodiment. As shown in FIG. 7, the dishwasher includes a tub 902 having a bottom 904 with an opening therethrough. A sump 906 is positioned in the bottom opening of the tub 902 and is coupled to a pump assembly 908. As shown in FIG. 7, a gap 912 exists between the top of the pump assembly 908 and an overlying portion of the sump 906. In this embodiment, the gap 912 is about twenty-two millimeters, and allows the sump 906 and the pump assembly 908 to be removed as a single assembly (if desired) from an interior side of the tub, without moving the dishwasher 900 from its installed position. In other embodiments, a larger or smaller gap (or no gap) may be employed.

The pump assembly 908 includes a motor having a shaft (not shown in FIG. 7). The pump assembly also includes a fluid inlet 916. The motor shaft has a center axis 914, and the fluid inlet 916 has a center axis 918. The tub bottom 904 includes a bottom surface 920. The sump 906 includes a support surface 922 for coupling the sump 906 to the tub 902. The shaft center axis 914 is spaced further from the sump surface 922 than is the center axis 918 of the fluid inlet 916. Further, the fluid inlet's center axis 918 is closer (in the vertical direction) to the bottom surface 920 of the tub bottom 904 than is the shaft center axis 914.

The dishwasher 900 of FIG. 7 also includes an access panel 910 located on its front side. The sump 906 may be the sump 404 shown in FIGS. 4-6 or any other suitable sump. Similarly, the pump assembly 908 may be the assembly 200 of FIGS. 2 and 3 or any other suitable assembly.

In the particular example of FIG. 7, the pump assembly 908 is mounted in the rear portion of the dishwasher 900 away from the access panel 910.

According to another aspect of this disclosure, a method of installing a sump/pump assembly in a dishwasher is provided. The method includes positioning the assembly within an interior portion of a dishwasher tub having a bottom opening, inserting at least the motor and the pump of the assembly through the bottom opening of the tub, and coupling the assembly to the dishwasher with the motor and the pump positioned below the tub bottom and with a center axis of the pump's fluid inlet positioned vertically closer to the tub bottom than is a center axis of the motor shaft. In this manner, the sump/pump assembly can be installed in the dishwasher preferably without moving the dishwasher from its installed position. For retrofit or replacement applications, the method may also include removing an existing sump/pump assembly from the dishwasher prior to inserting at least the motor and the pump through the bottom opening of the tub.

Figure 8:
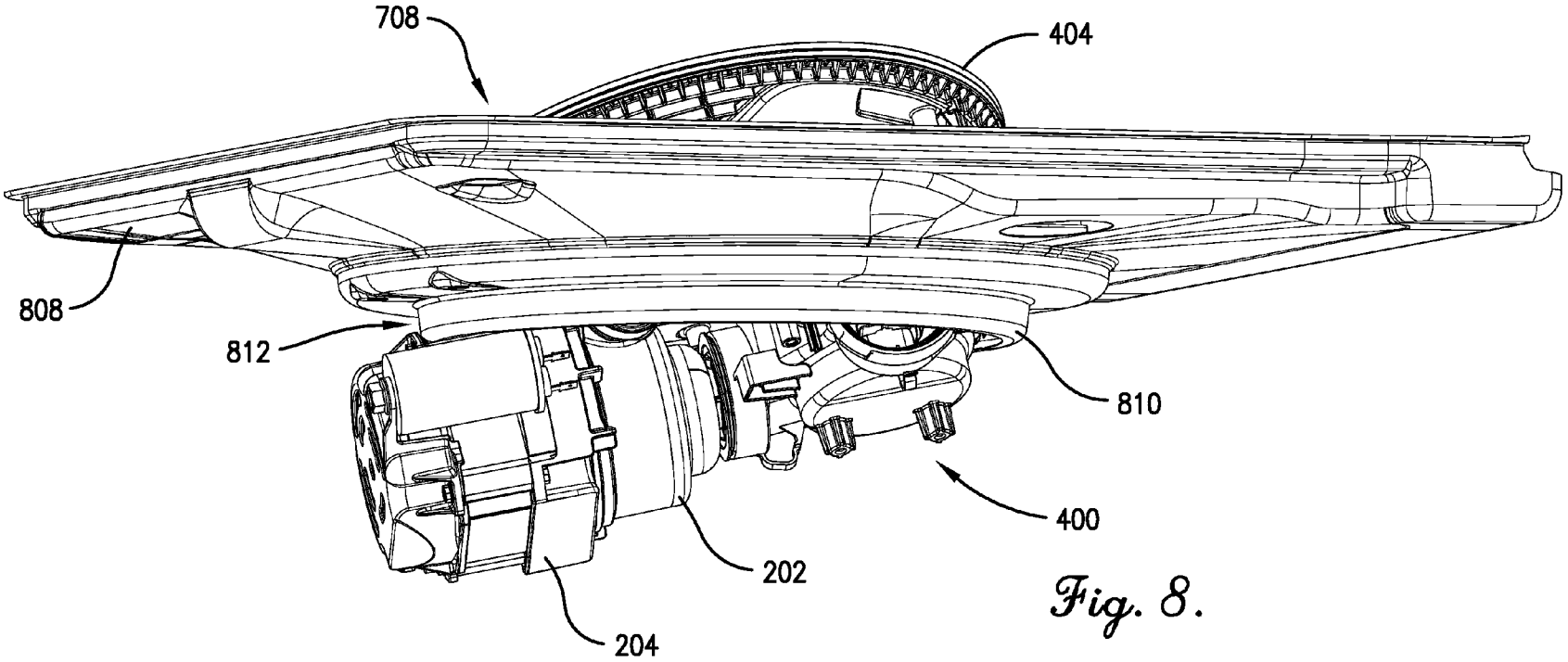
FIG. 8 is a side perspective view of the assembly of FIG. 4 as the assembly is installed in a dishwasher.
Figure 9:
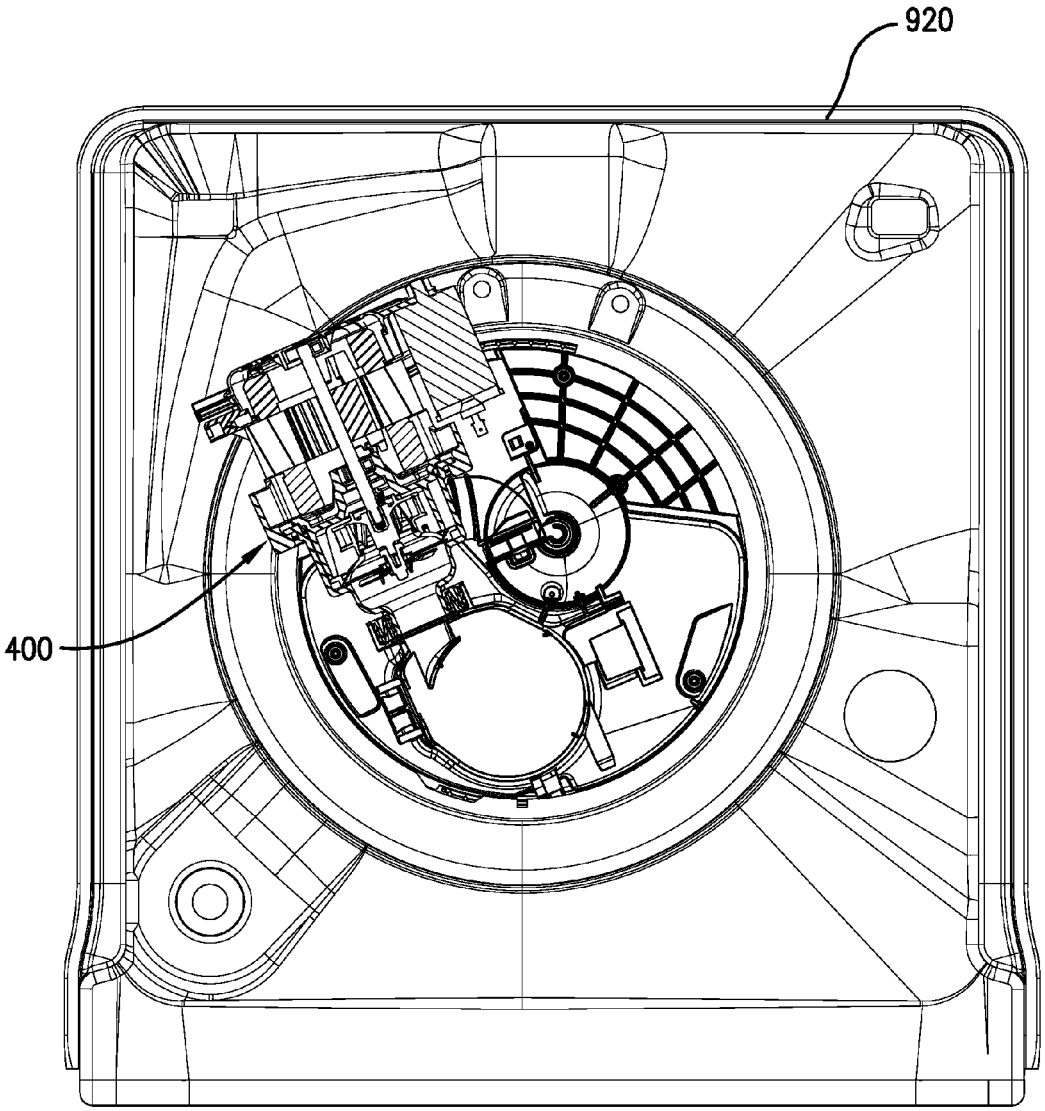
FIG. 9 is a bottom view of the assembly of FIG. 4 as installed in a dishwasher.

The method described above can be used to install any suitable sump/pump assembly in a dishwasher, including the assembly 400 of FIGS. 4-6. For example, FIG. 8 illustrates the assembly 400 as the pump 202 and the motor 204 are inserted through a bottom opening in a dishwasher tub 808 from an interior side of the tub 808. As shown in FIG. 8, the bottom opening in the tub 808 is defined by a rim 810. A portion of the rim 810 is positioned in the gap between the motor 204 and the sump 404 to facilitate installation of the assembly 400, preferably without moving the dishwasher from its installed position. FIG. 9 is a bottom view of the assembly 400 installed in a dishwasher 902.

Alternatively, the sump and the pump assembly can be installed separately and then coupled together (e.g., during manufacture of the dishwasher). For example, the sump can be installed in the dishwasher tub (e.g., from an interior side of the tub) with at least a portion of the sump positioned in the bottom opening of the tub (e.g., as shown in FIG. 7). Following that, the pump assembly can be positioned below the already installed sump (e.g., by passing the pump assembly through the dishwasher's front side opening that will subsequently be covered by the access panel 910). The pump assembly can then be coupled to the sump with the fluid inlet's center axis positioned vertically closer to (or, alternatively, farther from) the bottom surface of the tub bottom than is the shaft center axis.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A method of installing a sump/pump assembly in a dishwasher, the dishwasher including a tub having a bottom defining a bottom opening therethrough, the assembly including a sump, a pump, and a motor coupled to the sump, the pump including a fluid inlet, the motor including a shaft operably coupled to the pump for driving the pump, the method comprising the steps of:

(a) positioning the assembly within an interior portion of the tub;

(b) inserting at least the motor and the pump of the assembly through the bottom opening of the tub; and (c) coupling the assembly to the dishwasher with the motor and the pump positioned below the tub bottom and with a center axis of the fluid inlet positioned vertically closer to the tub bottom than is a center axis of the motor shaft.

2. The method of claim 1, further comprising the step of:

(d) prior to commencement of step (b), removing an existing sump/pump assembly from the dishwasher.

3. The method of claim 1, further comprising the step of:

(e) prior to commencement of step (c), positioning the assembly such that the sump at least substantially spans the opening.

4. The method of claim 1, step (c) further including the step of fluidly coupling the sump with the tub, such that fluid from the tub passes into the sump through the opening.

5. The method of claim 1, said sump including a support surface, said center axis of the motor shaft being spaced further from the support surface than is the center axis of the fluid inlet, step (c) further including the step of coupling the sump to the tub via engagement of the support surface with the tub, such that the sump is at least in part positioned below the sump opening.

6. The method of claim 1, further comprising the step of:

(f) prior to commencement of step (c), orienting the motor horizontally such that the center axis of the motor shaft extends generally horizontally.

7. The method of claim 1, said center axis of the motor shaft extending through the fluid inlet and being offset from the center axis of the fluid inlet.

8. The method of claim 7, said pump including a housing and a pumping chamber within the housing, said pumping chamber defining the fluid inlet and a fluid outlet, said center axis of the motor shaft at least in part extending through the pumping chamber.

9. The method of claim 7, said pump including an impeller having a central axis, said central axis of the impeller being aligned with the center axis of the motor shaft.

10. The method of claim 7, said center axis of the motor shaft being parallel to the center axis of the fluid inlet.

11. The method of claim 1, further comprising the step of:

(h) coupling the motor to the sump with a bracket.

12. The method of claim 11, said center axis of the fluid inlet being closer to the bracket than is the center axis of the motor shaft.

13. The method of claim 11, step (h) being completed prior to commencement of step (a).

14. The method of claim 1, step (b) further including the step of inserting the motor through the bottom opening of the tub.

15. The method of claim 14, step (b) further including the step of angling the motor relative to horizontal, such that the center axis of the motor shaft extends at an angle relative to horizontal, prior to the step of inserting the motor through the bottom opening of the tub.

16. The method of claim 15, step (b) further including the step of returning the motor to a horizontal orientation, such that the center axis of the motor shaft extends generally horizontally, after the step of inserting the motor through the bottom opening of the tub.

17. The method of claim 1, said pump including an impeller having a central axis, said central axis of the impeller being offset from the center axis of the fluid inlet.

* * * * *